US007168593B2

(12) United States Patent
Schroeder et al.

(10) Patent No.: US 7,168,593 B2
(45) Date of Patent: Jan. 30, 2007

(54) METHOD AND APPARATUS FOR A MIXING ASSEMBLY

(75) Inventors: Alfred A. Schroeder, San Antonio, TX (US); Michael T. Romanyszyn, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 176 days.

(21) Appl. No.: 10/869,122

(22) Filed: Jun. 16, 2004

(65) Prior Publication Data

US 2005/0279765 A1 Dec. 22, 2005

(51) Int. Cl.
*B67D 5/60* (2006.01)

(52) U.S. Cl. ..... 222/145.5; 222/129.1

(58) Field of Classification Search ..... 222/145.6, 222/145.5, 129.1, 129.2, 129.3, 129.4
See application file for complete search history.

(56) References Cited

U.S. PATENT DOCUMENTS 2,537,119 A * 1/1951 Bauerlein et al. ..... 137/594
2,653,733 A * 9/1953 Rudd et al. ..... 222/129.4
3,300,094 A * 1/1967 Rockola ..... 222/129.4
3,727,799 A * 4/1973 Nixon ..... 222/129.4
4,817,825 A * 4/1989 Freese ..... 222/129.2
5,186,363 A * 2/1993 Haynes ..... 222/145.5
5,188,255 A * 2/1993 Du ..... 222/1
5,228,597 A * 7/1993 Low ..... 222/129.1

* cited by examiner

*Primary Examiner*—Kevin Shaver
*Assistant Examiner*—Stephanie E. Tyler
(74) *Attorney, Agent, or Firm*—Christopher L. Makay

(57) ABSTRACT

A mixing assembly includes a mixing insert and a mixer housing that form a cavity when mated. The mixing insert includes orifices that penetrate the mixer insert. An inner vessel receives a product concentrate from a product concentrate source and the cavity receives a reconstituting fluid from a source, such that the reconstituting fluid is forced to exit the cavity through the orifices. Upon exiting the orifices, the reconstituting fluid engages the product concentrate stream, thereby reconstituting the product concentrate. The reconstituted product is then dispensed and evacuated from an end of a mixed product outlet tube, typically exterior to a protected environment, such as a chamber of a product dispenser. The mixing assembly includes varying mixing inserts to provide variable forms of engagement techniques.

11 Claims, 7 Drawing Sheets

METHOD AND APPARATUS FOR A MIXING ASSEMBLY

BACKGROUND OF THE INVENTION

1. Field of the Invention

The present invention relates to a method and apparatus for reconstituting a product concentrate and, more particularly, but not by way of limitation, to reconstituting a product concentrate with a mixing assembly.

2. Description of the Related Art

In the areas of food product dispensing and the reconstitution of product concentrates, the stability of a product in both the concentrate form and the reconstituted form can greatly enhance the usability of the product. Stable products typically have longer shelf lives and may be stored at room temperature. Unstable products usually require continuous refrigeration.

While the reconstitution of refrigerated product concentrates can be accomplished, caution must be employed when transferring the product concentrate, as well as the mixed product, from the refrigerated compartment to a dispense point exterior to the product dispenser. Exposure of the product to ambient conditions can lead to bacterial growth and unsanitary conditions. Exposure to air after being mixed still presents problems as nozzle tips and dispensing points often contain either the next dispense or a residue. Exposure of the nozzle tips and dispensing points that hold product to ambient conditions for extended periods can cause hardening, spoiling, and the eventual growth of bacteria.

Accordingly, the ability to reconstitute product in a refrigerated compartment without exposing the concentrate or the mixed products to ambient conditions would be beneficial to product dispenser manufacturers.

SUMMARY OF THE INVENTION

In accordance with the present invention, a mixing assembly reconstitutes a product concentrate. The concentrate stream and the reconstituting fluid do not mix until dispensing. The mixing assembly allows the reconstituting fluid to engage a product concentrate stream after separation from the mixing assembly. The reconstituted product stream is then dispensed at an end of a mixed product outlet tube. The dispense point is typically exterior to a protected environment, such as an interior chamber of a product dispenser. The mixing assembly includes varying mixing inserts to provide variable forms of engagement techniques. The mixing assembly may also be utilized within a refrigerated chamber to minimize exposure of the contents and the possibility of contamination.

In a refrigerated compartment, the product concentrate and the reconstituting fluid are protected from ambient temperatures. Use of the mixing assembly in a refrigerated compartment eliminates exposure of the product concentrate to ambient conditions. Locating the mixing assembly within the protected chamber minimizes the possibility of residues, spoilage and bacterial growth on or in dispense tips and nozzles that normally hold product for a next dispense.

It is therefore an object of the present invention to provide a mixing assembly for use in reconstituting product concentrates.

It is a further object of the present invention to provide a method for minimizing the chance of residual product being exposed to ambient conditions.

It is still further an object of the present invention to provide mixing within the confines of an interior compartment.

It is still yet further an object of the present invention to provide an alternative embodiment that maximizes the exposed surface area of a reconstituting fluid.

It is still yet further an object of the present invention to provide a product dispenser for use with the mixing assembly.

Still other objects, features, and advantages of the present invention will become evident to those of ordinary skill in the art in light of the following.

DETAILED DESCRIPTION OF THE PREFERRED EMBODIMENT

Figure 1:
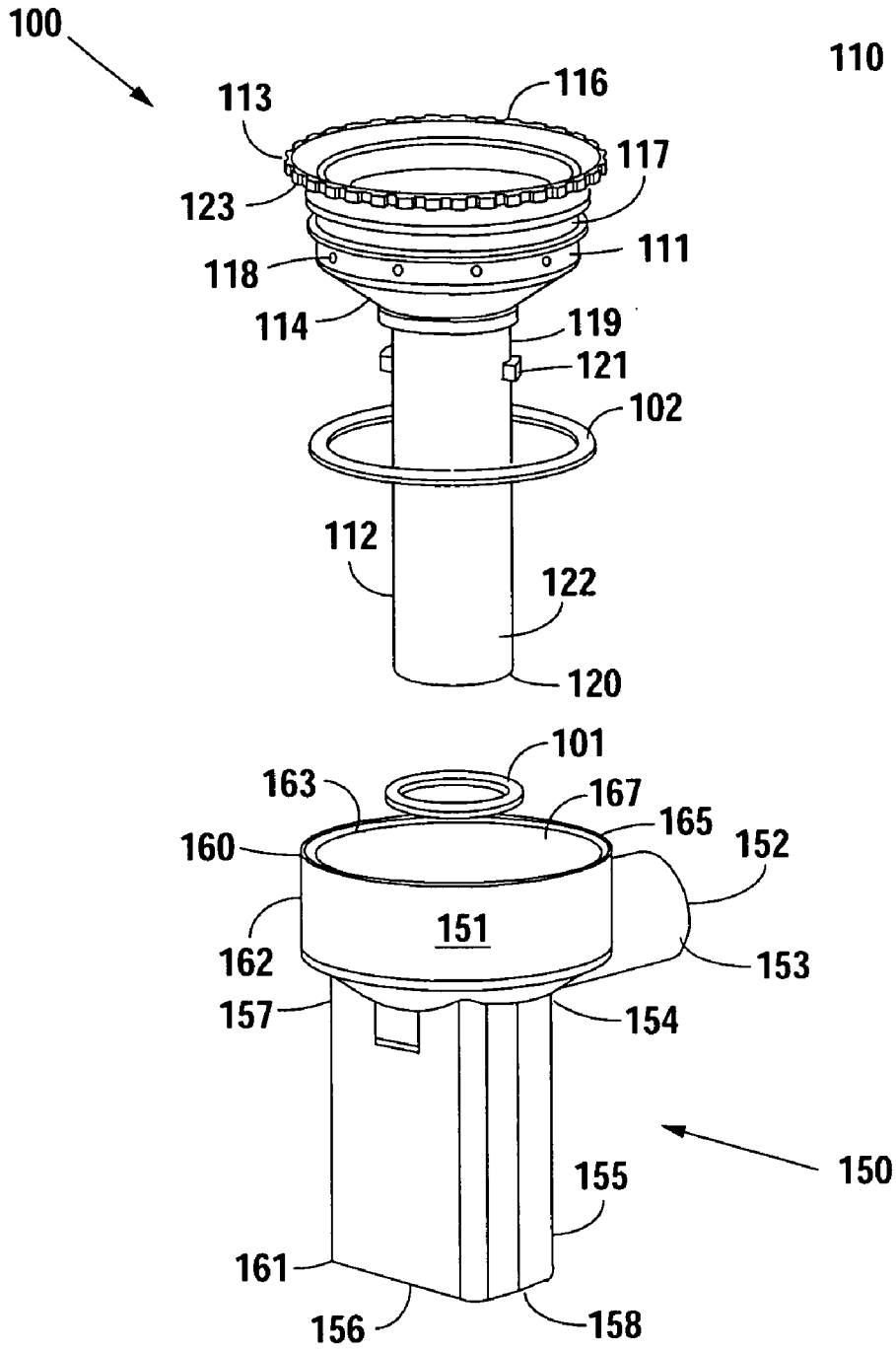
FIG. 1 provides an exploded view of a mixing assembly according to the preferred embodiment.
Figure 2:
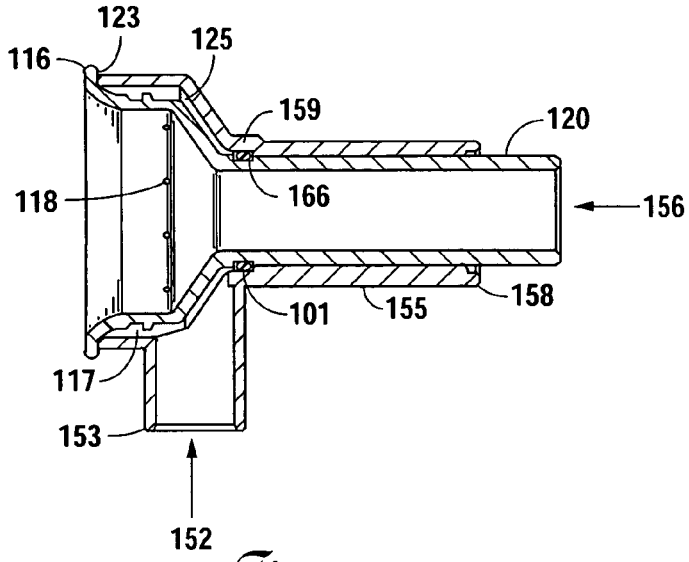
FIG. 2 provides a section view of the mixing assembly according to the preferred embodiment.
Figure 2A:
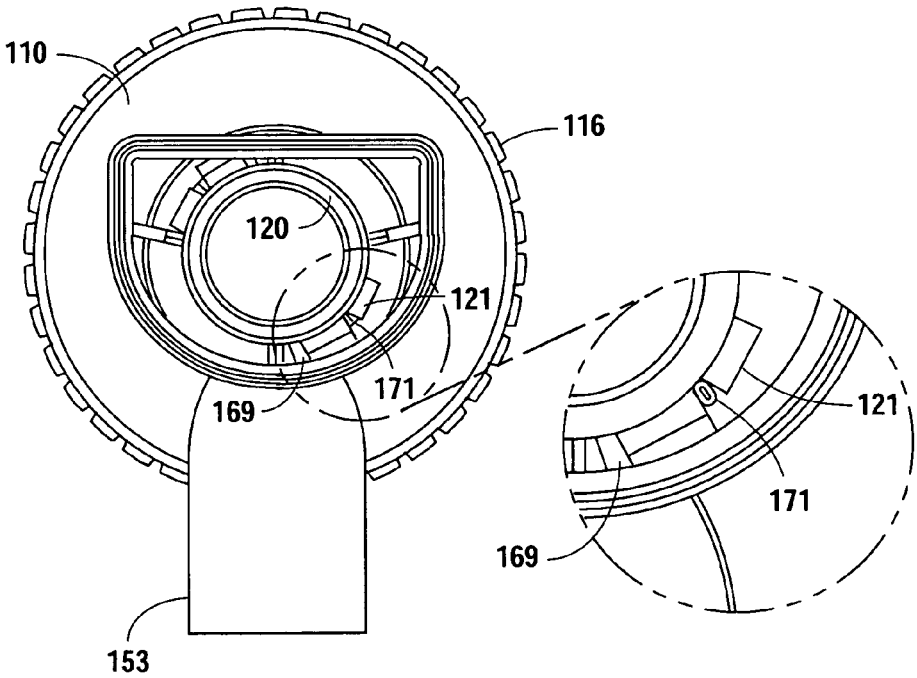
FIG. 2*a* provides a detail view illustrating locking features of the mixing assembly according to the preferred embodiment.

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

A mixing assembly provides the ability to reconstitute a product concentrate within a protected environment and the ability to deliver the reconstituted product outside of the protected environment. Benefits of the mixing assembly include separation of the product concentrate and reconstituting fluid streams until discharge from a dispensing device and the mixing assembly. The mixing assembly includes a series of orifices that force the reconstituting fluid to enter an inner vessel to engage a dispensed product concentrate stream dispensed from the dispensing device into the inner vessel. Once reconstituted, the mixed product stream moves down a mixed product outlet tube for use.

When used with a product concentrate in a controlled environment such as a refrigerated compartment of a product dispenser, the mixing assembly allows the product concentrate to be reconstituted within the confines of the refrigerated compartment, thereby eliminating the possibility of exposing the product concentrate to ambient conditions. The mixed product is dispensed through the mixed product outlet tube. The dispensed product is delivered outside of the product dispenser, thereby minimizing the possibility of residue buildup, spoilage, and bacterial growth. A second embodiment of the mixing assembly includes orifices in the shape of slots to provide a sheeting action, thereby maximizing the surface area of the reconstituting fluid.

As shown in FIGS. 1–6, a mixing assembly 100 includes a mixer housing 150, an o-ring 101, an o-ring 102, and a mixing insert 110. The mixer housing 150 includes a hollow cylindrical portion referred to as an outer vessel 151 in communication with a cylindrical section referred to as an inlet 152. The outer vessel 151 includes an upper end 160 and a lower end 161. The outer vessel 151 includes a cylindrical wall section 162. The cylindrical wall section 162 includes a bevel 163 used as a lead-in during assembly. The inlet 152 is mated to the outer vessel 151 and includes a first end 153 and a second end 154. The second end 154 of the inlet pipe 152 blends into the outer vessel 151, thereby creating a passage from the first end 153 of the inlet 152 to an interior of the outer vessel 151. The mixer housing 150 further includes a discharge member 155 having a first end 157 and a second end 158. The first end 157 of the discharge member 155 is connected to the lower end 161 of the outer vessel 151. In this preferred embodiment, the discharge member 155 is D-shaped; however, one of ordinary skill in the art will recognize that the discharge member 155 may be any shape, including specific shapes to complement existing dispensers. The discharge member 155 includes a cylindrical passage referred to as a tube guide 156. The tube guide 156 passes through the interior of the outer vessel 151 to the second end 158 of the discharge member 155 to create a passage therethrough.

The mixer housing 150 further includes an internal counterbore 159 having a cylindrical face 166 at the first end 157 of the tube guide 156. The counterbore 159 is of a size suitable for accepting the o-ring 101. The mixer housing 150 still further includes a tab stop 169 and an anti-rotation tab 171.

The mixing insert 110 includes an inverted truncated conical section referred to as an inner vessel 111 and a mixed product outlet tube 112. The inner vessel 111 is a hollow section and includes an upper end 113 and a lower end 114. The upper end 113 includes a cylindrical wall 115 attached to the conical section. The cylindrical wall 115 includes an o-ring groove 117 located on an exterior face. The inner vessel 111 further includes a lip 116 disposed on top of the cylindrical wall 115. The inner vessel 111 still further includes orifices 118 that penetrate through the cylindrical wall 115 to the hollow portion of the mixing insert 110. The orifices 118 are disposed around the axis of the conical section. The orifices in this preferred embodiment are circular in shape with a slight downward tilt, approximately fifty degrees from the horizontal to provide a force vector that complements the flow of the product concentrate stream. In this preferred embodiment, ten orifices 118 are utilized, however, one of ordinary skill in the art will recognize that virtually any number of orifices may be used depending upon product consistencies and mixing ratios.

The mixed product outlet tube 112 is hollow and includes a first end 119 and a second end 120. The first end 119 is attached to the lower end 114 of the inner vessel 111, and the second end 120 extends downward along the axis of the conical section to create a passage from the interior of the inner vessel 111 through to the second end 120 of the mixed product outlet tube 112. The mixed product outlet tube 112 further includes tabs 121 disposed on an outer surface 122.

On assembly, the o-ring 102 is placed around the inner vessel 111 and in the groove 117. Next, the o-ring 101 is placed over the second end 120 of the mixed product outlet tube 112, and the second end 120 of the mixed product outlet tube 112 is then inserted into the upper end 160 of the mixer housing 150 and through the tube guide 156 in the discharge member 155. The mixing insert 110 is then pushed through the tube guide 156 until a lower face 123 of the lip 116 contacts an engagement face 165 of the mixer housing 150. In this arrangement, the o-ring 101 creates seals against the cylindrical face 166 of the counterbore 159 and against the outer surface 122 of the mixed product outlet tube 112. Likewise, the o-ring 102 creates seals against the mixing insert 110 and an inner face 167 of the cylindrical wall 162.

Upon full engagement, the second end 120 of the mixed product outlet tube 112 protrudes from the second end 158 of the discharge member 155. Further, the mixing insert 110 may be rotated within the mixer housing 150 to engage the tabs 121 with the tab stops 169. During rotation, the tabs 121 flexibly pass over the anti-rotation tabs 171, thereby eliminating the possibility of inadvertent rotation of the mixing insert 110. The mating of the mixing insert 110 and the mixer housing 150 creates a cavity 125 between the outer vessel 151 of the mixer housing 150 and the inner vessel 111 of the mixing insert 110. The cavity 125 is accessible from the inlet 152 and the orifices 118. The mixing insert 110 is separable from the mixer housing 150 and may substituted with a mixing insert having a different orifice type.

Figure 3:
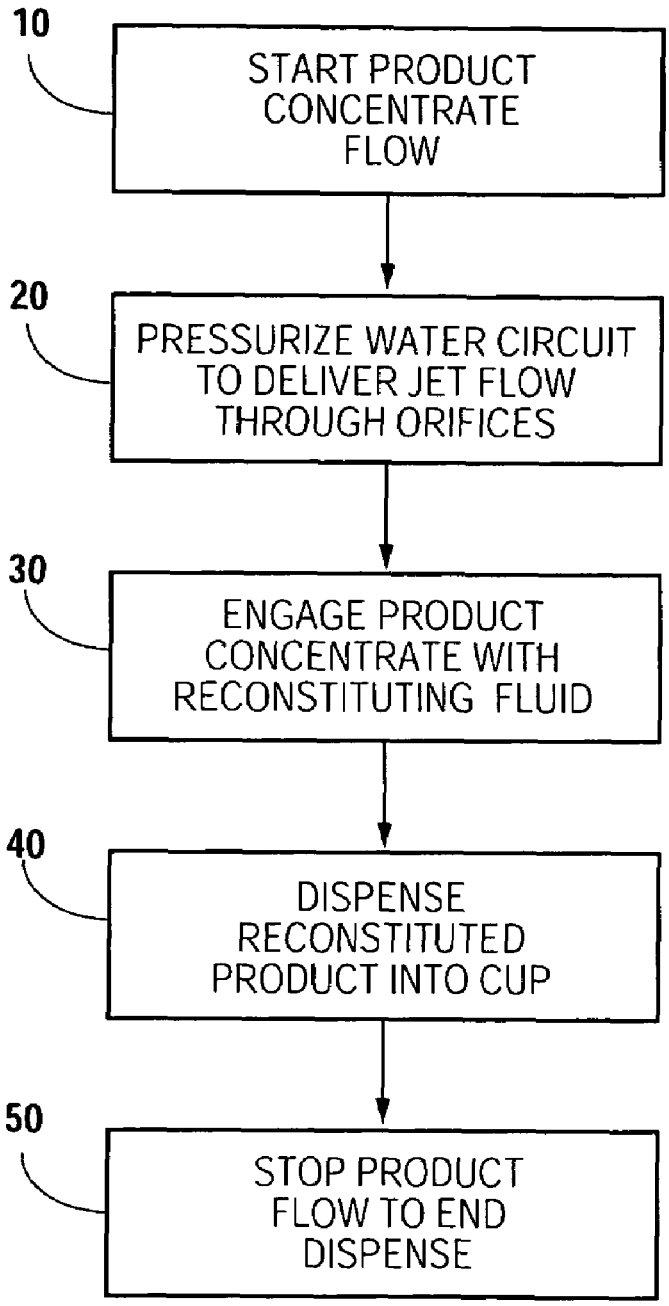
FIG. 3 provides a method flowchart illustrating the steps for using the mixing assembly according to the preferred embodiment.
Figure 4:
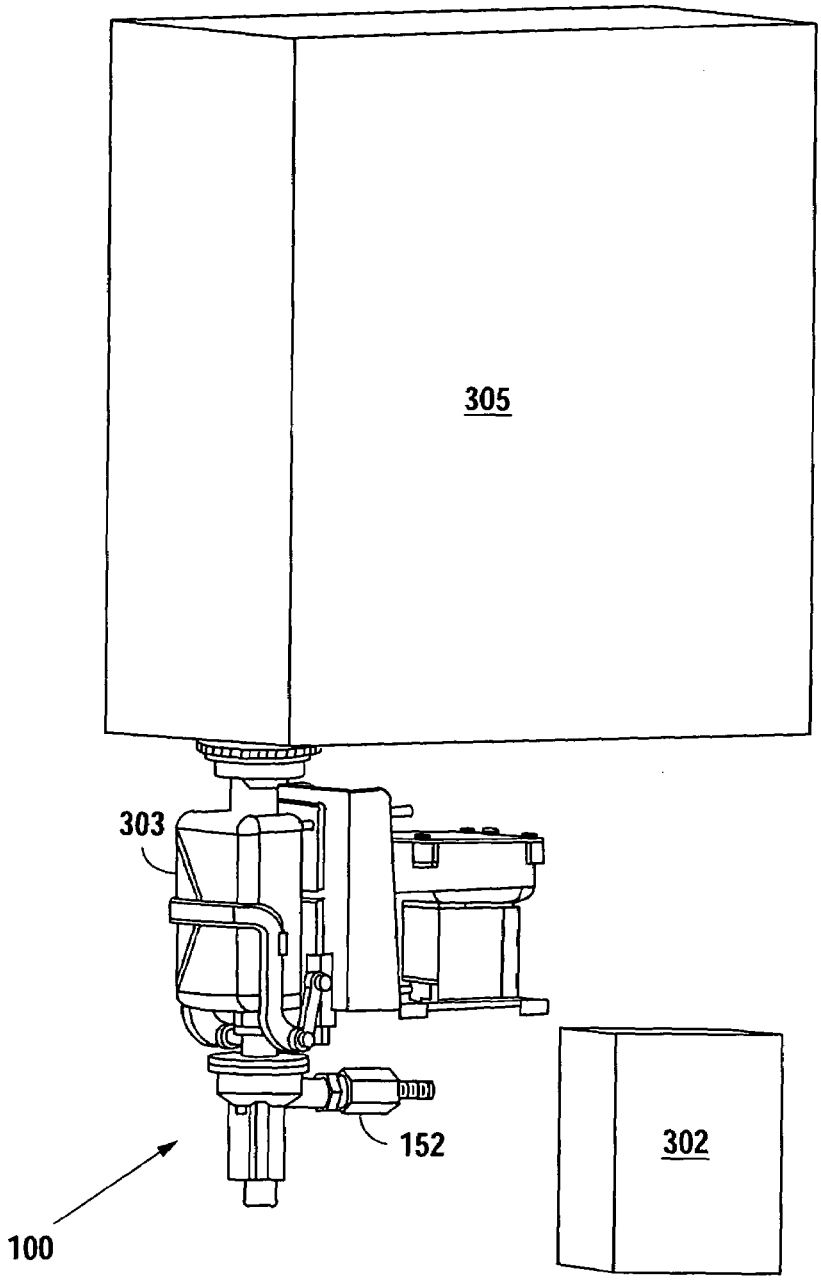
FIG. 4 illustrates a mixing assembly in relation to a product package and a dispensing device according to the preferred embodiment.

In use, a reconstituting fluid supply is connected to the first end 153 of the inlet 152. As shown in FIG. 3, step 10, a concentrated product is dispensed from any suitable product package 305 by any suitable dispensing device 303 into the inner vessel 111 of the mixing insert 110. In step 20, the flow of reconstituting fluid from the reconstituting fluid supply is activated to enter the inlet 152, thereby forcing the reconstituting fluid to flow into the cavity 125. Upon the filling of the cavity 125, the reconstituting fluid exits the cavity 125 through the orifices 118, thereby creating reconstituting fluid jets. The reconstituting fluid jets engage the concentrated product stream as it moves downward and reconstitutes the concentrated product stream, as shown in step 30. In step 40, the now reconstituted product moves down the mixed product outlet tube 112 to be dispensed into a consumer's cup. Step 50 stops the flow of the product stream, thereby ending the dispense. The combination of keeping the product concentrate stream and the reconstituting fluid stream separated until mixing minimizes the possibility of exposing the product concentrate to contamination, as the concentrate is generally more stable than the reconstituted product.

It should be clear to one of ordinary skill in the art that any suitable product package may be utilized, including soft packages, hard packages, packages with a dispense tubing, and the like. It should further be noted that while the mixing assembly 100 has been shown in use without a controller, one of ordinary skill in the art will recognize that a controller 302 or other processing device may be used to provide signals to other peripheral equipment, such as a flow control mechanism or the dispensing device 303.

Figure 5:
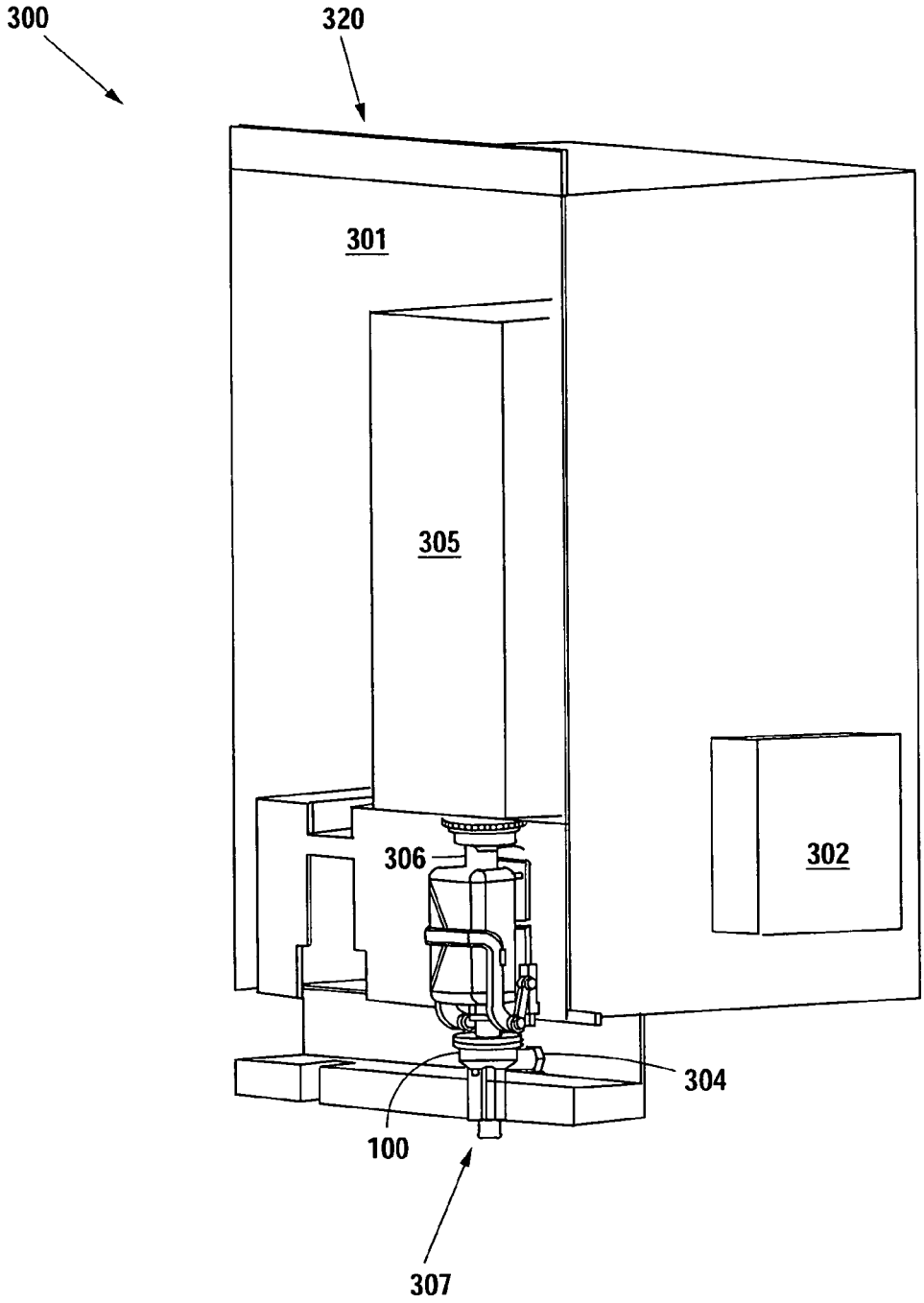
FIG. 5 provides a perspective view of a product dispenser utilizing mixing assembly according to an alternative embodiment.

As shown in FIG. 5, the mixing assembly 100 may also be utilized in any enclosed interior chamber 301, including that of a product dispenser 300. The product dispenser 300 may include a housing 320 containing the interior chamber 301 for housing a product package 305. The product package 305 may include a dispense tube 306 for use with a peristaltic pump. The product dispenser 300 may further include a controller 302, a dispensing device 303, a reconstituting fluid outlet 304, and a passage 307. The product dispenser 300 may be of the type commonly used to reconstitute and dispense products. The interior compartment 301 may be refrigerated for dispensing products that are not shelf-stable. The interior compartment 301 may include the reconstituting fluid outlet 304 and the dispensing means 303. The product package 305 may be of virtually any type commonly utilized in the industry to distribute food and food concentrate items.

The dispensing device 303 may be of any suitable pumping system including peristaltic pumps and positive displacement pumps. The controller 302 may be utilized to control the dispense operations. The passage 307 passes through a wall of the product dispenser 300 to connect the interior chamber 301 to the ambient environment. The mixing assembly 100 may be disposed through the passage 307 such that the second end 120 of the mixed product outlet tube 112 is located outside of the product dispenser 300. In this configuration, the inner vessel 111, the outer vessel 151, the cavity 125, and the inlet 152 are located within the confines of interior chamber 301.

Figure 6:
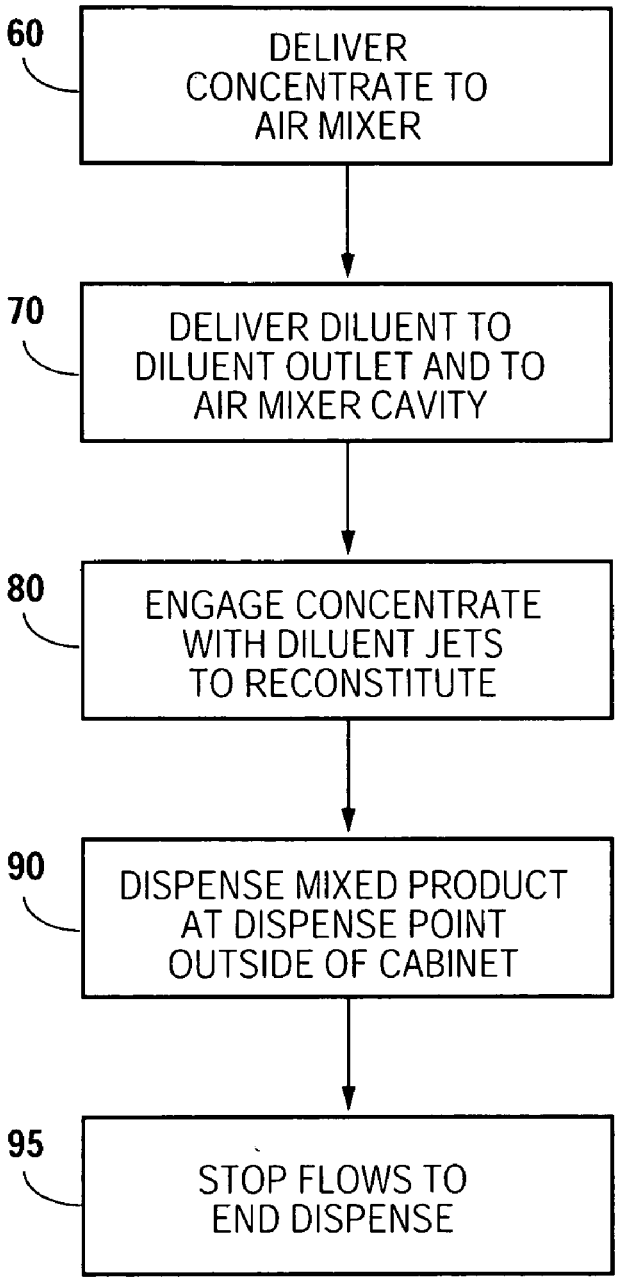
FIG. 6 provides a method flowchart illustrating the steps associated with reconstituting a product within an interior compartment of a product dispenser.
Figure 7:
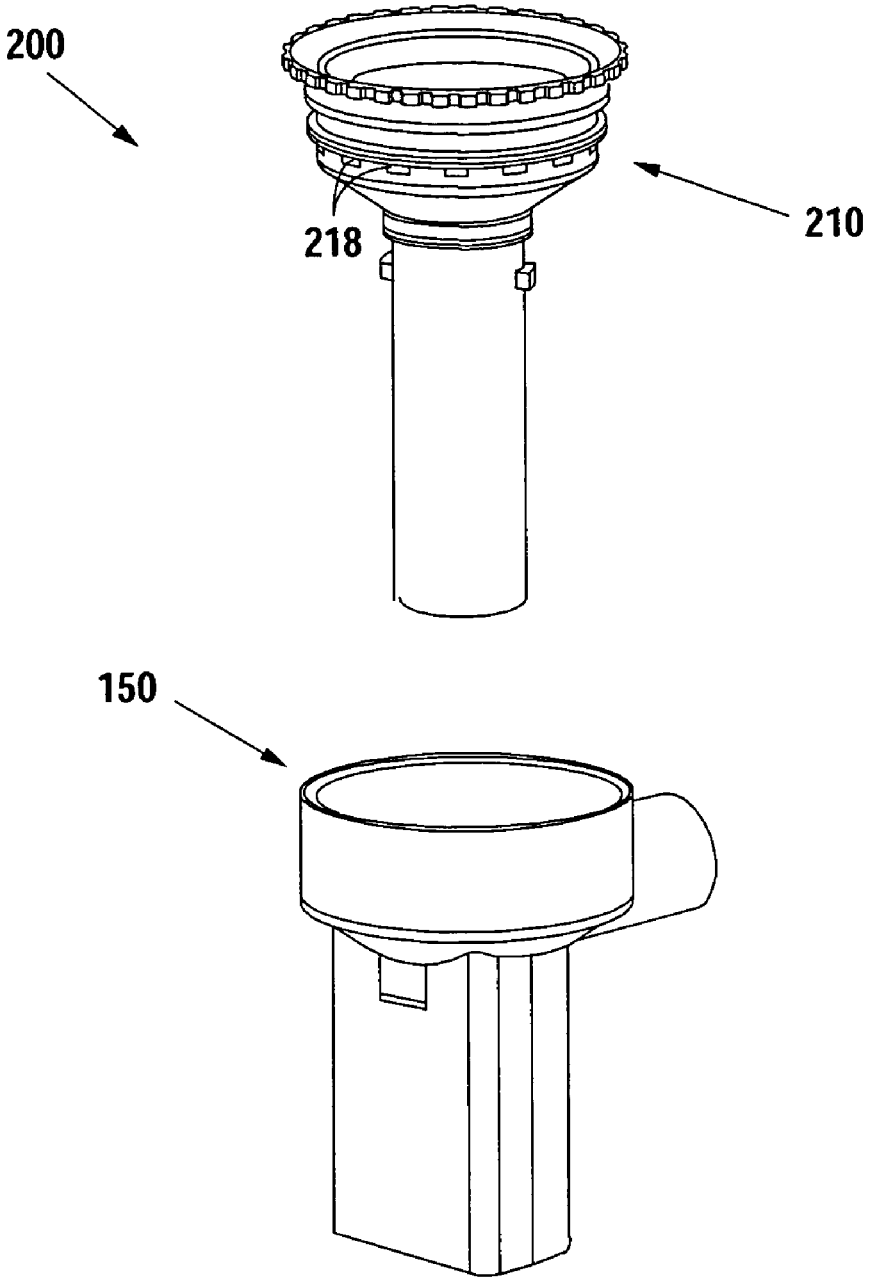
FIG. 7 provides an exploded view of a mixing assembly according to a second embodiment.

As shown in the method flowchart of FIG. 6, the process of using the mixing assembly 100 within an interior compartment 301 of a product dispenser 300 commences with step 60, wherein the concentrate is delivered to the mixing assembly 100 that resides within the interior compartment 301. The process continues with the delivery of a reconstituting fluid to an outlet 304 disposed within the refrigerated cabinet and in fluid communication with the inlet pipe 152 of the mixing assembly 100 as shown in step 70. Step 80 provides for delivering the reconstituting fluid to the cavity 125 from the reconstituting fluid source, thereby forcing the reconstituting fluid to exit the cavity 125 through the orifices 118. The reconstituting fluid exits the orifices 118 in the form of a jet and engages the concentrate product stream. The concentrated product is reconstituted and moves down the mixed product outlet tube 112. The use of a circular orifice 118 provides an increased velocity component for an elevated level of interaction with the concentrate stream. The reconstituted product is dispensed through the second end 120 of the mixed product outlet tube 112 that is located outside of the interior chamber 301, as shown in step 90. Step 95 provides for stopping the flow of the reconstituting fluid and the product concentrate stream to end the dispense. Once the product flow has been terminated, the reconstituted product drains from the mixed product outlet tube 112. The draining of the mixed product outlet tube 112 eliminates the necessity to hold product in the dispense tip or nozzle for a future dispense.

Use of the mixing assembly 100 in an interior chamber 301 of a product dispenser 300 protects both the product concentrate and the reconstituting fluid from ambient air conditions and the bacterial growth associated therewith. The inner bowl 111 and the outer bowl 151, the cavity 125, and the inlet pipe 152 are totally enclosed within the interior chamber 301 of the product dispenser 300. In this preferred embodiment, the outlet member 155 protrudes through the chamber 301 of the product dispenser 300 to provide a dispensing point. Concentrated product never reaches the mixed product outlet tube 112, and therefore is not exposed to the ambient conditions until the concentrate product is dispensed and reconstituted. Reconstituted product then flows down the mixed product outlet tube 112 to exit the protected chamber 301. Dispense remnants and areas such as dispense nozzles no longer hold product for dispensing, thereby eliminating the problems normally associated with exposing products to ambient air conditions for extended periods.

While this preferred embodiment has been shown for use with a protected interior chamber 301, it should be clear to one of ordinary skill in the art that the protected interior chamber 301 may include refrigerated chambers, as well as non-refrigerated chambers. A protected mechanism for mixing and dispensing provides a cleaner and fresher approach to product dispensing.

In a second embodiment, a mixing assembly 200 includes a mixing insert 210 substantially identical to the mixing insert 110, and like parts have been referenced with like numerals. In this embodiment, the mixing insert 210 and the mixer housing 150 operate identically to the first embodiment. Mixing insert 210 however differs from mixing insert 110 in that it includes orifices 218 in the shape of slots. Passage of the reconstituting fluid through orifices 218 in the shape of slots forces the reconstituting fluid to form a sheet, thereby maximizing the amount of surface area available for interaction with the reconstituting fluid.

While the first and second embodiments have been shown with circular holes and slots, respectively, it should be clear to one of ordinary skill in the art that the orifices may be of any shape suitable discharge the reconstituting fluid from the cavity 125 to engage and reconstitute a product concentrate stream.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A product dispenser, comprising:

a product dispenser housing including an interior compartment, a reconstituting fluid outlet, a passage coupling the interior compartment exterior to the product dispenser housing, and a product source disposed within the interior compartment and communicating with the passage; and a mixing assembly disposed in the passage, the mixing assembly comprising a mixing insert and a mixer housing defining a cavity therebetween, wherein an inlet of the mixing assembly inlets reconstituting fluid into the cavity from the reconstituting fluid outlet of the housing, and further wherein an inner vessel of the mixing assembly receives product from the product source and reconstituting fluid through orifices coupling the cavity to the inner vessel for reconstituting of the product and delivery exterior to the product dispenser housing.

2. The product dispenser according to claim 1, wherein the product is a concentrate.

3. The product dispenser according to claim 1 wherein the reconstituting fluid source is disposed within the housing.

4. The product dispenser according to claim 1 wherein the reconstituted product is dispensed through a mixed product outlet tube that passes through the passage and exits the product dispenser housing.

5. The product dispenser according to claim 1 wherein the orifices are circular in shape to create jets for increased interaction.

6. The product dispenser according to claim 1 wherein the orifices are in the shape of slots, thereby maximizing the surface area of the reconstituting fluid for mixing.

7. The product dispenser according to claim 1, wherein the inner vessel is in communication with a mixed product outlet tube.

8. The product dispenser according to claim 1, wherein the reconstituting fluid engages the product concentrate stream in air while within the confines of the inner vessel.

9. The product dispenser according to claim 1 wherein the reconstitution occurs as the concentrate stream and the reconstituting fluid streams pass through the mixing assembly.

10. The product dispenser according to claim 9, wherein the reconstituted product evacuates the mixing assembly after each dispense, thereby eliminating the need to house product at a dispense point for a future dispense.

11. A method of reconstituting a product, comprising:

a. placing a mixing assembly comprising a mixing insert and a mixer housing defining a cavity therebetween in a passage of a product dispenser housing, such that an outlet end of the mixing assembly is disposed exterior to the product dispenser housing;

b. delivering a concentrated product into the mixing insert of the mixing assembly, wherein the mixing insert is in communication with a mixed product outlet tube, and further wherein the mixing insert includes orifices;

c. delivering a reconstituting fluid into the cavity surrounding the mixing insert, thereby forcing the reconstituting fluid to exit the cavity through the orifices;

d. delivering the reconstituting fluid from the cavity into the mixing insert through the orifices, thereby engaging the product concentrate stream with the reconstituting fluid passing through the orifices, thereby reconstituting the product concentrate stream; and e. dispensing the mixed product though the mixed product outlet tube to a point exterior to the product dispenser housing.

* * * * *